US008574800B2

(12) United States Patent
Okita et al.

(10) Patent No.: US 8,574,800 B2
(45) Date of Patent: Nov. 5, 2013

(54) TONER FOR ELECTROSTATIC CHARGE IMAGE DEVELOPMENT, ELECTROSTATIC CHARGE IMAGE DEVELOPER, TONER CARTRIDGE, PROCESS CARTRIDGE AND IMAGE FORMING DEVICE

(75) Inventors: Masahiro Okita, Kanagawa (JP); Yutaka Saito, Kanagawa (JP); Yasuaki Hashimoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 649 days.

(21) Appl. No.: 12/634,199

(22) Filed: Dec. 9, 2009

(65) Prior Publication Data

US 2010/0330482 A1 Dec. 30, 2010

(30) Foreign Application Priority Data

Jun. 26, 2009 (JP) ..... 2009-153039

(51) Int. Cl.
*G03G 9/08* (2006.01)
*G03G 9/097* (2006.01)

(52) U.S. Cl.
USPC ..... 430/108.3; 430/108.4; 430/110.4

(58) Field of Classification Search
USPC ..... 430/108.3, 108.4, 110.4
See application file for complete search history.

(56) References Cited

U.S. PATENT DOCUMENTS 5,629,123 A 5/1997 Tomono et al.
6,160,142 A 12/2000 Sawada et al.
6,330,420 B1 * 12/2001 Honda ..... 399/346
6,503,675 B1 1/2003 Kabai
2004/0219448 A1 * 11/2004 Kato et al. ..... 430/108.6
2006/0063082 A1 * 3/2006 Mikuriya et al. ..... 430/108.3
2006/0222986 A1 10/2006 Veregin et al.

FOREIGN PATENT DOCUMENTS

JP A-60-198556 10/1985
JP A-61-231562 10/1986
JP A-61-231563 10/1986
JP A-6-59498 3/1994
JP A-11-323396 11/1999
JP A-2000-250251 9/2000
JP A-2004-326049 11/2004
JP A-2006-154491 6/2006

(Continued)

OTHER PUBLICATIONS

European Search Report issued in European Patent Application No. 10 15 6217.1 dated Nov. 2, 2010.

(Continued)

*Primary Examiner* — Jonathan Jelsma
(74) *Attorney, Agent, or Firm* — Oliff & Berridge, PLC.

(57) ABSTRACT

A toner for electrostatic charge image development includes toner particles and fatty acid metal salt particles. The content of the fatty acid metal salt particles is from 0.2 parts by weight to 5 parts by weight with respect to 100 parts by weight of the toner particles; the weight of fatty acid metal salt particles remaining on a sieve having an opening of 25 μm when the toner is sieved with the sieve having an opening of 25 μm is from 0.015% by weight to 0.300% by weight with respect to the total weight of the toner; and the weight of fatty acid metal salt particles remaining on a sieve having an opening of 45 μm when the toner is sieved with the sieve having an opening of 45 μm is 0.030% by weight or less with respect to the total weight of the toner.

12 Claims, 1 Drawing Sheet

(56) References Cited

FOREIGN PATENT DOCUMENTS

| | | |
|---|---|---|
| JP | A-2006-284827 | 10/2006 |
| JP | A-2006-301008 | 11/2006 |
| JP | A-2008-304838 | 12/2008 |

OTHER PUBLICATIONS

Jun. 25, 2013 Office Action issued in Japanese Application No. 2009-153039 (with English translation).

* cited by examiner

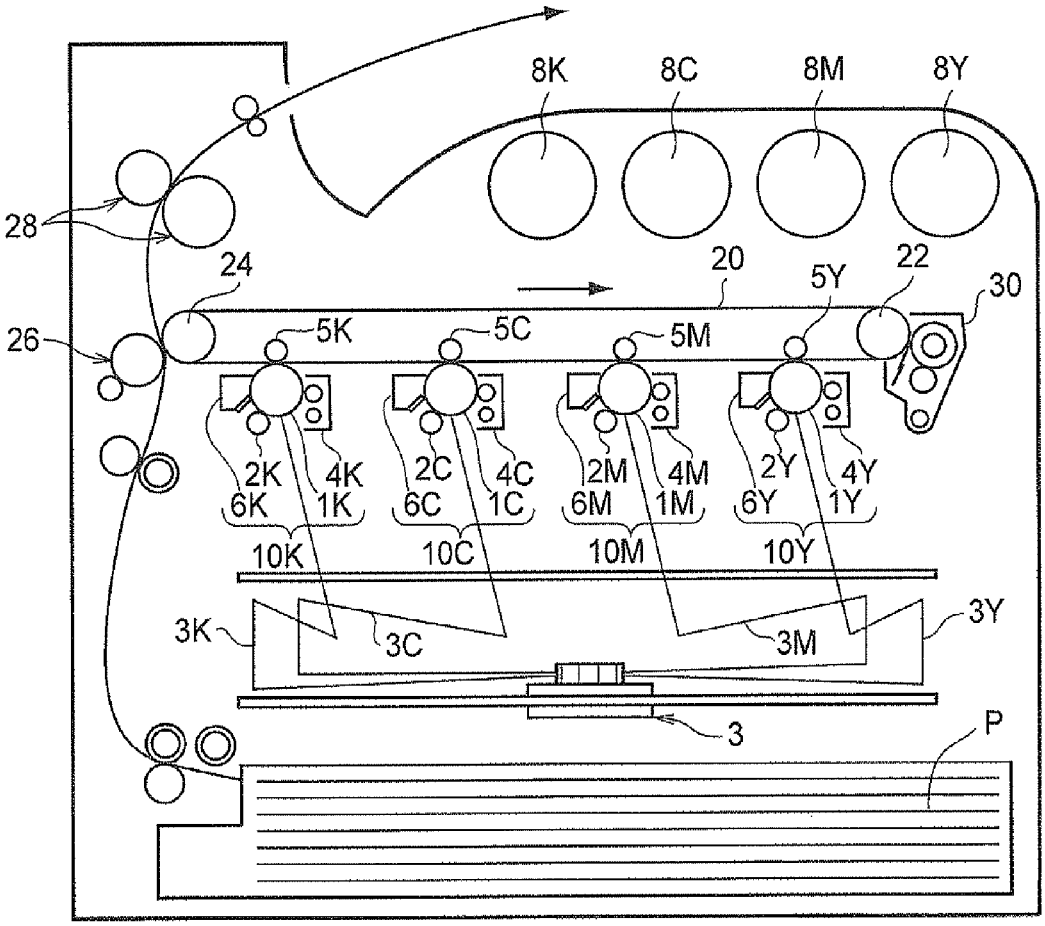
8K
8C
8M
8Y
28
24
20
5Y
22
30
26
5K
5C
5M
2K
4K
6K
1K
2C
4C
6C
1C
2M
4M
6M
1M
2Y
4Y
6Y
1Y
10K
10C
10M
10Y
3K
3C
3M
3Y
3
P

TONER FOR ELECTROSTATIC CHARGE IMAGE DEVELOPMENT, ELECTROSTATIC CHARGE IMAGE DEVELOPER, TONER CARTRIDGE, PROCESS CARTRIDGE AND IMAGE FORMING DEVICE

CROSS-REFERENCE TO RELATED APPLICATION

This application is based on and claims priority under 35 USC 119 from Japanese Patent Application No. 2009-153039, filed on Jun. 26, 2009.

BACKGROUND

1. Technical Field

The present invention relates to a toner for electrostatic charge image development, an electrostatic charge image developer, a toner cartridge, a process cartridge and an image forming device.

2. Related Art

An image forming mechanism which is widely used in image forming devices, such as copying machines and printers, and utilizes electrophotographic technology, includes: a charging process that forms an electrostatic charge on the surface of an electrostatic latent image holder; an electrostatic latent image forming process that forms an electrostatic latent image on a surface of the electrostatic latent image holder by irradiating the surface of the electrostatic latent image holder with light from a light source; a developing process that forms a toner image by developing the electrostatic latent image formed on the surface of the electrostatic latent image holder with a developer including a toner for electrostatic charge image development (toner); a transfer process that transfers the toner image formed on the surface of the electrostatic latent image holder onto a recording medium; and a fixing process that fixes the transferred toner image onto an output medium, thereby forming an image. After the transfer process, the electrostatic latent image holder is subjected to a cleaning process whereby residue on the surface of the electrostatic latent image holder is removed by a cleaning member, and the electrostatic latent image holder is subjected to the charging process again. In the cleaning process, the surface of the electrostatic latent image holder after the transfer process is brought into contact with a cleaning blade, so that residue on the surface of the electrostatic latent image holder is scraped off and the scraped residue is transferred into a recovery container or the like.

SUMMARY

According to an aspect of the invention, there is provided a toner for electrostatic charge image development including toner particles and fatty acid metal salt particles, the content of the fatty acid metal salt particles being from 0.2 parts by weight to 5 parts by weight with respect to 100 parts by weight of the toner particles;

the weight of fatty acid metal salt particles remaining on a sieve having an opening of 25 μm when the toner is sieved with the sieve having an opening of 25 μm being from 0.015% by weight to 0.300% by weight with respect to the total weight of the toner; and the weight of fatty acid metal salt particles remaining on a sieve having an opening of 45 μm when the toner is sieved with the sieve having an opening of 45 μm being 0.030% by weight or less with respect to the total weight of the toner.

BRIEF DESCRIPTION OF THE DRAWINGS

FIG. 1 is a schematic structural drawing showing an example of an image forming device according to the present exemplary embodiment.

DETAILED DESCRIPTION

Toner for Electrostatic Charge Image Development

The toner for electrostatic charge image development according to the present exemplary embodiment (hereafter, may be referred to as the "toner of the present exemplary embodiment") includes toner particles and fatty acid metal salt particles, and the content of the fatty acid metal salt particles is from 0.2 parts by weight to 5 parts by weight (or about 0.2 parts by weight to about 5 parts by weight) relative to 100 parts by weight of the toner, and when the toner is sieved with a sieve having an opening of 25 μm, the weight of the fatty acid metal salt particles remaining on the sieve is from 0.015% by weight to 0.300% by weight (or from about 0.015% by weight to about 0.300% by weight) relative to the total weight of the toner, and when the toner is sieved with a sieve having an opening of 45 μm, the weight of the fatty acid metal salt particles remaining on the sieve is 0.030% by weight or less (or about 0.030% by weight or less) relative to the total weight of the toner.

In general, in an image forming device having a system in which residue on a surface of the electrostatic latent image holder is scraped off by contacting a cleaning blade with a surface of the electrostatic latent image holder after transfer of a toner image, transfer residue including toner remaining after transfer of a toner image to a recording medium or the like is accumulated at a portion at which the cleaning blade is in contact with the surface of the electrostatic latent image holder (this portion is hereinafter referred to as a "blade nip portion"). In contrast, when a toner containing fatty acid metal salt particles is used, the fatty acid metal salt particles also come to the blade nip portion and impart lubricity, thereby suppressing the accumulation of transfer residue.

However, density unevenness may arise when the fatty acid metal salt particles are included in a toner without further consideration. In particular, density unevenness is significant under high temperature and high humidity conditions (for example, 30° C. and 85% RH (the same applies hereinafter)), and under low temperature and low humidity conditions (for example, 10° C. and 12% RH (the same applies hereinafter)). The reason of occurrence of the density unevenness is presumed to be as follows:

(i) Transfer residue accumulated at the blade nip portion is thought to include toner particles, fatty acid metal salt particles and other external additives.

(ii) It is thought that the amount of transfer residue to be accumulated at the blade nip portion is large at a region on the surface of the electrostatic latent image holder at which an image was formed, and that the amount of transfer residue accumulated at the nip portion is small at a region on the surface of the electrostatic latent image holder at which an image was not formed. Further, it is though that this tendency is remarkable under high temperature and high humidity conditions due to decreased flowability. Moreover, it is thought that this tendency is more remarkable under low temperature and low humidity conditions due to a change in elasticity of the cleaning blade.

(iii) It is thought that aggregates are formed at the blade nip portion by deformation and compression of toner particles, fatty acid metal salt particles and other external additives, and that the aggregates cause an adverse effect on contact characteristics and lubricity between the surface of the electrostatic latent image holder and the cleaning blade.

(iv) In view of the above, it is thought that a difference in the amount of the transfer residue arises between the region on the surface of the electrostatic latent image holder at which an image was formed and the region on the surface of the electrostatic latent image holder at which an image was not formed, resulting in a difference in cleaning performance. As a result, the surface of the electrostatic latent image holder is worn nonuniformly, and density unevenness occurs.

In consideration of the above, the toner according to the present exemplary embodiment is designed such that, when the toner is sieved with sieves respectively having openings of 25 μm and 45 μm, the amount of fatty acid metal salt particles that remain on each sieve is a specific amount, as a result of which an image with suppressed density unevenness may be obtained.

More specifically, the toner according to the present exemplary embodiment is designed such that when the toner is sieved with a sieve having an opening 25 μm, the weight of the fatty acid metal salt particles remaining on the sieve is from 0.015% by weight to 0.300% by weight relative to the total weight of the toner, and when the toner is sieved with a sieve having an opening 45 μm, the weight of the fatty acid metal salt particles remaining on the sieve is 0.030% by weight or less relative to the total weight of the toner. It has been found by the present inventors that due to this configuration, the shape and structure of transfer residue accumulated at the blade nip portion are controlled, and the density unevenness may be suppressed even under high temperature and high humidity conditions and under low temperature and low humidity conditions. The reason therefor is thought to be as follows: the fatty acid metal salt particles at the blade nip portion has decreased tendency to form aggregates by deformation and compression, and thus nonuniform wear of the photoreceptor may be suppressed.

Here, the classification using the sieve having an opening of 25 μm is carried out in the following manner.

Toner (30.0 g) is added into a beaker containing 500 g of a 3.0% by weight aqueous sodium dodecylbenzene sulfonate solution while stirring, and a toner dispersion liquid is prepared using an ultrasonic cleaner. When a toner to be tested is mixed with a carrier, the ratio of the carrier is determined beforehand, and the toner dispersion liquid is prepared such that the amount of the toner is 30.0 g. The carrier is separated from the dispersion liquid using a magnet.

Next, a Buchner funnel for ϕ70 mm filter paper is attached to a suction bottle, and a stainless-steel sieve for a test (having an opening of 25 μm (JIS Z 8801), ϕ75 mm and a height of 20 mm (manufactured by Tokyo Screen Co., Ltd.)) with a tare precisely weighted is set onto the Buchner funnel. The gap between the sieve and the side surface of the Buchner funnel is sealed with PARAFILM (manufactured by Pechiney Plastic Packaging Company).

The toner dispersion liquid is poured onto the sieve from above while the air is suctioned from the suction bottle. Subsequently, 500 g of a 1.0% by weight aqueous sodium dodecylbenzene sulfonate solution is used for rinsing the inner surface of the Buchner funnel and removing the toner adhered to the mesh portion of the sieve. Further, the mesh portion of the sieve is rinsed with a mixed solution of ion exchange water and ethanol at weight ratio of 80:20. Thereafter, the sieve is detached from the Buchner funnel and is air-dried. The weight of the sieve after being dried is precisely weighed. The difference in the sieve weight between before and after sieving is assumed to be the amount of the residue on the sieve per 30 g of the toner, and thus, the ratio of residue is obtained. As the ratio of the residue on the 25 μm opening sieve, the average of the measurement values obtained by performing the above operations three times is used.

In some cases, particles other than the fatty acid metal salt particles are included in the particles remaining on the sieve. Therefore, an elemental analysis of the surface of the toner particles is performed by an X-ray fluorescence spectroscopy prior to the dispersing, whereby the quantities of element(s) (such as silicon, titanium, cerium or strontium) contained in the metal oxide(s) and of metal element(s) (for example, zinc) which form the fatty acid metal salt(s) are roughly determined. Then, an elemental analysis is performed again after the particles remaining on the sieve are dried, so that the weight ratio of particles other than the fatty acid metal salt particles is obtained. The weight of the particles other than the fatty acid metal salt particles is determined based on the obtained weight ratio of the particles other than the fatty acid metal salt particles and is subtracted, whereby the weight of only the fatty acid metal salt particles that remain on the sieve is determined. When silicon, titanium, cerium or strontium is the metal of the fatty acid metal salt, the weight of the fatty acid metal salt particles cannot be clearly distinguished from the weight of the metal oxides. However, these elements (silicon, titanium, cerium and strontium) are not usually used as the metals of the fatty acid metal salts, and, needless to say, fatty acid salts of silicon, titanium, cerium and strontium are excluded from the scope of fatty acid metal salts.

Further, the classification using the sieve with an opening of 45 μm is carried out by the following manner.

The ratio of residue on the sieve with an opening of 45 μm is determined in a similar manner to the determination of the ratio of residue on the sieve with an opening of 25 μm, except that the sieve is changed to a stainless-steel sieve for a test (having an opening of 45 μm (JIS Z 8801), ϕ75 mm, and a height of 20 mm (manufactured by Tokyo Screen Co., Ltd.)).

The weight of the fatty acid metal salt particles remaining on the sieve when the toner is sieved with a sieve having an opening 25 μm is preferably from 0.015% by weight to 0.2% by weight, and more preferably from 0.015% by weight to 0.1% by weight, relative to the total weight of the toner. When the value is 0.015% by weight or more, an excessively high ratio of the fatty acid metal salt particles in the transfer residue accumulated at the blade nip portion may be suppressed, and the accumulation of the transfer residue may be suppressed. When the value is 0.300% by weight or less, occurrence of image defects such as color streaks may be suppressed.

Moreover, the weight of the fatty acid metal salt particles remaining on the sieve when the toner is sieved with a sieve having an opening of 45 μm is preferably 0.02% by weight or less, and more preferably 0.01% by weight or less, relative to the total weight of the toner. When the value is 0.030% by weight or less relative to the total weight of the toner, occurrence of image defects such as white spots may be suppressed. Needless to say, it is desirable that the lower limit of the value is 0% by weight.

(Fatty Acid Metal Salt Particles)

In the toner according to the present exemplary embodiment, the content of the fatty acid metal salt particles is from 0.2 parts by weight to 5 parts by weight, preferably from 0.5 parts by weight to 3 parts by weight, and more preferably 0.5 parts by weight to 1 part by weight, relative to 100 parts by weight of the toner particles. When the content of the fatty acid metal salt particles is less than 0.2 parts by weight relative to 100 parts of the toner particles, lubricity may not be sufficiently imparted, toner filming may occur, developed images may be uneven, and as a result, image irregularity may appear. On the other hand, when the content of the fatty acid metal salt particles is more than 5 parts by weight, the accumulation of the transfer residue may not be suppressed, as a result of which uneven wear of the photoreceptor may easily occur, and, in some cases, image irregularity may not be easily suppressed. Here, the content of the fatty acid metal salt particles with respect to 100 parts by weight of toner particles is determined as follows. The fatty acid is identified by an NMR analysis of the fatty acid moiety of the fatty acid metal salt present on the surface of the toner particles, the content of metal (for example, zinc) in the toner is determined by an X-ray fluorescence spectroscopy, and the amount of the fatty acid metal salt is calculated therefrom.

Moreover, in the toner according to the present exemplary embodiment, the ratio of the fatty acid metal salt particles having a particle diameter of 25 μm or more in the particle size distribution of the fatty acid metal salt particles may be from 4.0% by weight to 30.0% by weight (or from about 4.0% by weight to about 30.0% by weight), and the ratio of the fatty acid metal particles having a particle diameter of 40 μm or more in the particle size distribution of the fatty acid metal salt particles may be 2.0% by weight or less (or about 2.0% by weight or less). When the particle size distribution of the fatty acid metal salt particles is in the above ratio, the density unevenness may be suppressed. The particle diameter of the fatty acid metal salt particles is measured by MULTISIZER II (trade name; manufactured by Beckman Coulter, Inc.). When the particle diameter to be measured is from 3 μm 20 μm, a tube having an aperture of 100 μm is used for the measurement. When the particle diameter to be measured is from 20 μm to 100 μm, a tube having an aperture of 200 μm is used for the measurement. Hereinafter, the method of determining the particle size distribution of the fatty acid metal salt particles is described.

First, 1 g of the toner according to the present exemplary embodiment is placed in a 1 L beaker, and 500 g of a 2% by weight aqueous solution of sodium dodecylbenzene sulfonate in ion exchange water is added into the beaker. Thereafter, the mixture is subjected to a dispersion process using an ultrasonic cleaner, and, after the particles to be measured are dispersed, the toner and the fatty acid metal salt particles are separated using a centrifugal separator. Since the density of fatty acid metal salt particles is less than one and the density of toner is generally one or more, supernatant is separated from the obtained liquid, and the particle diameters of the particles are measured. More specifically, measurement with MULTISIZER II is performed with the particle diameter channels (16 channels in the range of from 1.587 μm to 64 μm), and the ratio of particles having a particle diameter of 25 μm or more is determined from the sum of the values of the observed volume percents for the particle diameter channels of 25.398 μm or more. Further, the ratio of particles having a particle diameter of 40 μm or more is determined from the sum of the values of observed volume percents for the particle diameter channels of 40.317 μm or more.

The ratio of the fatty acid metal salt particles having a diameter of 25 μm or more in the particle size distribution of the fatty acid metal salt particles may be from 4.0% by weight to 30.0% by weight, preferably from 5.0% by weight to 20% by weight, and more preferably from 5% by weight to 15% by weight. When the ratio of particles having a diameter of 25 μm or more is less than 4.0% by weight, stirring of the transfer residue accumulated at the blade nip portion is decreased, and the cleaning property at a region of the surface of the electrostatic latent image holder at which an image was formed may become different from that of a region at which an image was not formed, so that color streaks occur in some cases. On the other hand, when the ratio of particles having a diameter of 25 μm or more exceeds 30.0% by weight, the quantity of the fatty acid metal salt particles supplied to the blade nip portion decreases, as a result of which toner filming occurs in some cases.

Moreover, the ratio of the fatty acid metal salt particles having a diameter of 40 μm or more in the particle size distribution of the fatty acid metal salt particles may be 2.0% by weight or less, preferably 1.0% by weight or less, and more preferably 0.5% by weight or less. The fatty acid metal salt particles having a diameter of 40 μm or more tend to separate from the developer in the image forming device, and may have poor transportability. As a result, the fatty acid metal salt particles having a diameter of 40 μm or more are less likely to reach the blade nip portion, and may shift to the side to which the output image is transferred (toward, for example, an intermediate transfer belt), thereby causing image defects such as white spots in some cases.

The fatty acid metal salt particles used in the present exemplary embodiment are particles of at least one salt formed by a fatty acid and a metal.

The fatty acid may be any of a saturated fatty acid or an unsaturated fatty acid, and a fatty acid having from 10 to 25 carbon atoms are preferable. Examples of the saturated fatty acid include lauric acid, stearic acid and behenic acid. Stearic acid is preferable. Moreover, examples of the unsaturated fatty acid include oleic acid and linoleic acid.

The metal may be a divalent metal, and examples of the metal include magnesium, calcium, aluminum, barium and zinc. Magnesium, calcium and zinc are preferable.

Examples of the fatty acid metal salt of the fatty acid metal salt particles include aluminum stearate, calcium stearate, potassium stearate, magnesium stearate, barium stearate, lithium stearate, zinc stearate, copper stearate, lead stearate, nickel stearate, strontium stearate, cobalt stearate, sodium stearate, zinc oleate, manganese oleate, iron oleate, aluminum oleate, copper oleate, magnesium oleate, calcium oleate, zinc palmitate, cobalt palmitate, copper palmitate, magnesium palmitate, aluminum palmitate, calcium palmitate, zinc laurate, manganese laurate, calcium laurate, iron laurate, magnesium laurate, aluminum laurate, zinc linolate, cobalt linolate, calcium linolate, zinc ricinoleate and aluminum recinoleate.

Further, the fatty acid metal salt particles are preferably particles of at least one fatty acid metal salt having a melting point of from 40° C. to 200° C., from the viewpoint of, for example, flowability and/or fixability. Among the examples of the fatty acid metal salt particles described above, zinc stearate particles, zinc laurate particles and magnesium stearate particles are more preferable, and zinc stearate particles are still more preferable.

Examples of the method of preparing the fatty acid metal salt include a method of cation-substituting a fatty acid alkali metal salt and a method of allowing a fatty acid to react directly with a metal hydroxide. For example, a method of producing zinc stearate may be a method of cation-substituting sodium stearate and a method of allowing stearic acid to react with zinc hydroxide.

(Toner Particles)

The toner particles in the present exemplary embodiment include a binder resin and a release agent, and may include a colorant, if necessary. Further, particles, which are generally called external additive, may be added in order to control the flowability and charging property. Hereafter, the components that are included in the toner particles are explained.

<Binder Resin>

Examples of binder resins include homopolymers or copolymers of styrenes such as styrene or chlorostyrene; monoolefins such as ethylene, propylene, butylene or isoprene; vinyl esters such as vinyl acetate, vinyl propionate or vinyl benzoate; α-methylene aliphatic monocarboxylates such as methyl acrylate, ethyl acrylate, butyl acrylate, dodecyl acrylate, octyl acrylate, phenyl acrylate, methyl methacrylate, ethyl methacrylate, butyl methacrylate or dodecyl methacrylate; vinyl ethers such as vinyl methyl ether, vinyl ethyl ether or vinyl butyl ether; and vinyl ketones such as vinyl methyl ketone, vinyl hexyl ketone or vinyl isopropenyl ketone.

In particular, representative binder resins include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene, polypropylene and the like. Examples of representative binder resins further include urethane-modified products of the above resins and epoxy-modified products of the above resins. Among them, polyester is preferable. For example, a polyester resin formed from a polycondensate product of monomers that include bisphenol A and a polyvalent aromatic carboxylic acid as main monomer components may be used.

<Release Agent>

Examples of release agents include low-molecular-weight polyolefins such as polyethylene, polypropylene or polybutene; silicones exhibiting a softening point when heated; fatty amides such as oleamide, erucamide, ricinolamide or stearamide; vegetable waxes such as ester wax, carnauba wax, rice wax, candelilla wax, Japan tallow or Jojoba oil; animal waxes such as beeswax; mineral waxes such as Montan wax, ozokerite, ceresin, paraffin wax, microcrystalline wax or Fischer-Tropsch wax; petroleum waxes and modified products thereof.

<Colorant>

Examples of the colorant include various pigments such as carbon black, Chrome Yellow, Hansa Yellow, Benzidine Yellow, Threne Yellow, Quinoline Yellow, Permanent Orange GTR, Pyrazolone Orange, Vulcan Orange, Watchyoung Red, Permanent Red, Brilliant Carmine 3B, Brilliant Carmine 6B, DuPont Oil Red, Pyrazolone Red, Lithol Red, Rhodamine B Lake, Lake Red C, Rose Bengal, Aniline Blue, Ultramarine Blue, Calco Oil Blue, Methylene Blue Chloride, Phthalocyanine Blue, Phthalocyanine Green or Malachite Green Oxalate; and various dyes such as acridine-based dyes, xanthene-based dyes, azo-based dyes, benzoquinone-based dyes, azine-based dyes, anthraquinone-based dyes, thioindigo-based dyes, dioxazine-based dyes, thiazine-based dyes, azomethine-based dyes, indigo-based dyes, phthalocyanine-based dyes, aniline black-based dyes, polymethine-based dyes, triphenylmethane-based dyes, diphenylmethane-based dyes, or thiazole-based dyes. The colorant may be used alone, or two or more thereof may be used in combination.

<Other Additives>

Other additives may further be added to the toner particles in the present exemplary embodiment, and examples of the additives include: magnetic materials such as ferrite, magnetite, metals (such as reduced iron, cobalt, nickel or manganese), alloys or oxides thereof or compounds including these metals; metal oxides such as silica, alumina or titania; and calcium carbonate. Further, a charge control agent may be added, which may be a known charge control agent such as a quaternary ammonium salt, a nigrosine compound, a dye formed from a complex of aluminum, iron or chromium, or a triphenylmethane pigment.

<External Additive>

Examples of external additives include known external additives such as inorganic particles or organic particles. More specifically, examples of external additives include inorganic particles such as particles of silica, titania, alumina, cerium oxide, strontium titanate, calcium carbonate, magnesium carbonate or calcium phosphate; and organic resin particles such as acrylic resin particles, methacrylic resin particles, fluorine-containing resin particles, silicone particles or melamine particles. Examples of external additives further include particles of which surface has been subjected to a surface treatment with an alkyl silane coupling agent or the like.

The volume average particle diameter of the toner particles in the present exemplary embodiment is preferably from 4 μm to 10 μm (or from 4 μm to 10 μm), and is more preferably from 5 μm to 7 μm. When the volume average particle diameter of the toner particles is from 4 μm to 10 μm, the effect of suppressing density unevenness may be exerted. The volume average particle diameter of the toner particles is measured by MULTISIZER II (trade name; manufactured by Beckman Coulter, Inc.). When the particle to be measured has a diameter of from 3 μm 20 μm, an aperture tube of 100 μm is used for the measurement, and when the particle to be measured has a particle diameter of from 20 μm to 100 μm, an aperture tube of 200 μm is used for the measurement.

Examples of a method of producing toner particles of the present exemplary embodiment include a kneading-pulverization method in which the constituent materials of the toner particles are kneaded, pulverized and classified, a method in which the shape of the particles obtained by the kneading-pulverization method is changed by applying mechanical impact or heat energy; an emulsion polymerization aggregation method in which a dispersion liquid obtained by emulsion polymerization of at least one polymerizable monomer for forming a binder resin is mixed with at least one dispersion liquid of a colorant, a release agent, and, optionally, a charge control agent, and the mixture is aggregated and thermally fused to obtain colored particles; a suspension polymerization method in which a solution containing at least one polymerizable monomer for forming a binder resin, a colorant, a release agent, and, optionally, a charge control agent and the like, is suspended in an aqueous solvent and polymerized; and a dissolution suspension method in which a solution containing a binder resin, a colorant, a release agent, and, optionally, a charge control agent and the like, is suspended in an aqueous solvent and granulated. Further, aggregated particles may further be allowed to attach to a core formed by the colorant particle obtained by the above methods, and heating may be performed to fuse the aggregated particles to the core to form a particle having a core-shell structure. Furthermore, known mixers such as a type V blender, Henschel mixer or Lodige mixer may be used for mixing the obtained particles with the external additive(s).

The toner according to the present exemplary embodiment may be obtained in such a manner that the fatty acid metal salt particles are pulverized by a jet mill and the like, and the pulverized particles are classified by Elbow-jet classifier, and the fatty acid metal salt particles with a controlled particle distribution are produced, and the resultant fatty acid metal salt particles are mixed with toner particles using known mixers such as a type V blender, Henschel mixer or Lodige mixer. The mixing may be performed at the same time when external additives are added externally to the toner particles.

<Electrostatic Charge Image Developer>

The toner for electrostatic charge image development according to the present exemplary embodiment may be used on its own as a one-component developer or may be used in a two-component developer. When used in a two-component developer, it is used in a mixture with a carrier.

Carriers that is used for the two-component developer are not specifically restricted, and known carriers may be used. Examples of a core material of a carrier include a core material formed from iron powder or a metal oxide such as ferrite, both of which are magnetic substances; and a magnetic-powder-dispersed core material in which magnetic particles as internal additive are added to resin particles that serve as a matrix. A core material containing a metal oxide, iron powder, or the like may be coated with a resin (coating resin) for the purpose of regulating electric resistance and/or charging properties.

The magnetic components may be any known components such as ferrite, magnetite or hematite. An example of ferrite is a compound represented by the following formula:

$$(MO)_X(Fe_2O_3)_Y$$

(in the formula, M represents at least one selected from the group consisting of Cu, Zn, Fe, Mg, Mn, Ca, Li, Ti, Ni, Sn, Sr, Al, Ba, Co, and Mo. X and Y each represent a molar ratio, and satisfy the equation X+Y=100).

Examples of the resin for covering the core material include polyolefin resins (for example, polyethylene and polypropylene), polyvinyl and polyvinylidene resins (for example, polystyrene, acrylic resin, polyacrylonitrile, polyvinyl acetate, polyvinyl alcohol, polyvinyl butyral, polyvinyl chloride, polyvinyl carbazole, polyvinyl ether and polyvinyl ketone), vinyl chloride-vinyl acetate copolymer, styrene-acrylic copolymer, straight silicone resins containing organosiloxane bonds or modified products thereof, fluororesins (for example, polytetrafluoroethylene, polyvinyl fluoride, polyvinylidene fluoride and polychlorotrifluoroethylene), polyesters, polyurethanes, polycarbonates, amino resins (for example, urea-formaldehyde resin), and epoxy resins. The resin may be used alone, or two or more thereof may be mixed and used.

The resin that covers the core material may be a polymer or copolymer of at least one monomer selected from styrene, an acrylic ester or a methacrylic ester. Specifically, the resin may be a polymer such as polystyrene, polymethyl methacrylate, or polybutyl acrylate, or a copolymer such as a styrene-methyl methacrylate copolymer, or a styrene-ethyl methacrylate copolymer. These thermoplastic resins are favorable in view of their excellent charging properties and excellent capability of retaining zeolite particles.

Examples of a method of mixing the core material and the resin for covering the core material include a spray method in which a solution for forming a resin coating layer is sprayed onto the surface of the carrier core particles; a fluidized-bed method in which a solution for forming a resin coating layer is sprayed onto the surface of the carrier core particles while the carrier core particles are floated with fluidizing air; a kneader coater method in which carrier core particles and a solution for forming a resin coating layer are mixed in a kneader coater, and subsequently, a solvent is removed; and a powder coating method in which resin particles and core particles are mixed, while heating, to coat the core particles with the resin. Further, for the purpose of regulating the electric resistance of the carrier and charge-imparting performance, components other than the resin component may be added, such as the external additives described in the description of the toner particles.

The shape factor SF1 of the carrier particles in the present exemplary embodiment is preferably 127 or less (or about 127 or less), and is more preferably 125 or less. Here, a perfectly spherical carrier particle has a shape factor SF1 of 100, and the shape factor is calculated according to the following formula:

$$SF1=100\pi\times(ML)^2/(4\times A).$$

In the formula, ML represents the absolute maximum length of a carrier particle, and A represents the project area of the carrier particle.

For example, the shape factor of carrier particles is calculated as follows. An optical microscopic image of carrier particles sprayed in the form of a monolayer on a slide glass is inputted to an image analyzer (LUZEX III (trade name; manufactured by Nireco Corporation)) using a camcorder, and the maximum lengths and the projection areas of the carrier particles are measured. The shape factor SF1 of each carrier particle is calculated according to the above formula, and the mean value of the shape factors of 100 carrier particles is assumed to be the shape factor SF1 of the carrier. From the viewpoint of image quality, the shape factor SF1 of the carrier is more preferably 124 or less.

In general, as the shape of the carrier particle becomes closer to the perfect sphere, the magnetic brush at the time of development becomes more uniform, so that high quality image may easily be obtained. However, carrier particles having high sphericity may cause scratches on the surface of the electrostatic latent image holder, which may generate color streaks. In particular, in low temperature and low humidity environments, the frequency of the occurrence of color streaks may be high. This is because although most of the carrier particles scattered from the developing device are supposed to be recovered and removed from the stirring section at the upstream side of the blade nip section, some of the carrier particles reach the blade nip section if the carrier particles have high sphericity, as a result of which scratches are generated on the surface of the electrostatic latent image holder and color streaks are formed. However, when the toner according to the present exemplary embodiment is used, fatty acid metal salt particles that have larger particle diameters in the particle size distribution thereof enhance the stirring of the transfer residue (residue on the electrostatic latent image holder after transfering) accumulated at the blade nip section, and prevents the carrier particles from reaching the blade nip section.

The volume average particle diameter of the carrier particles is, for example, from 20 μm to 70 μm (or from about 20 μm to about 70 μm). The volume average particle diameter of the carrier particles is measured in a similar manner to the measurement of the volume average particle diameter of the toner particles described above.

In the developer according to the present exemplary embodiment, the toner according to the present exemplary embodiment and the carrier are mixed at a weight ratio of, for example, from 1:100 to 30:100 (toner:carrier).

<Toner Cartridge for Electrostatic Charge Image Development, Process Cartridge and Image Forming Device>

A toner cartridge for electrostatic charge image development according to the present exemplary embodiment (hereinafter, referred to as "cartridge according to the present exemplary embodiment" in some cases) is attachable to and detachable from an image forming device, and accommodates the developer according to the present exemplary embodiment described above. With this configuration, an image in which image density unevenness is suppressed may be obtained.

An image forming device according to the present exemplary embodiment includes an electrostatic latent image holder, a charging unit that charges a surface of the electrostatic latent image holder, an electrostatic latent image forming unit that form an electrostatic latent image on the surface of the electrostatic latent image holder, a developing unit that develops the electrostatic latent image with the above-described developer according to the present exemplary embodiment to form a toner image, a transfer unit that transfers the toner image to a recording medium, and a cleaning unit having a cleaning blade that removes residual developer remaining on the surface of the electrostatic latent image holder.

Further, a process cartridge according to the present exemplary embodiment includes a developing unit that develops the electrostatic latent image with the above-described developer according to the present exemplary embodiment to form a toner image and at least one selected from the group consisting of an electrostatic latent image holder, a charging unit that charges a surface of the electrostatic latent image holder, or a cleaning unit having a cleaning blade that removes residual developer remaining on the surface of the electrostatic latent image holder.

Hereafter, the image forming device according to the present exemplary embodiment is described with reference to the drawing.

FIG. 1 is a schematic drawing showing an example of the configuration of an image forming device according to the present embodiment. The image forming device shown in FIG. 1 is a 4-drum tandem color image forming device and provided with first to fourth electrophotographic image forming units 10Y, 10M, 10C and 10K, which respectively output Yellow (Y), Magenta (M), Cyan (C) and Black (K) color images based on color-separated image data. The image forming units (hereinafter also referred to as "unit" or "units") 10Y, 10M, 10C and 10K are arranged in parallel to one another such that the image forming units 10Y, 10M, 10C, and 10K are separated from one another in the horizontal direction. The units 10Y, 10M, 10C and 10K may be process cartridges that are attachable to and detachable from the image forming device main body.

An intermediate transfer belt 20 is provided as an intermediate transfer member and extends through each of the units 10Y, 10M, 10C and 10K at the upper side (referring to the direction in FIG. 1) of the units 10Y, 10M, 10C and 10K. The intermediate transfer belt 20 is wound around a support roller 24 and a drive roller 22, both of which contact the inner surface of the intermediate transfer belt 20 and are separated from each other in the direction (the direction in FIG. 1) of left to right. The intermediate transfer belt 20 runs in a direction from the first unit 10Y to the fourth unit 10K. The support roller 24 is biased in a direction that gets farther from the drive roller 22 by a spring or the like (not shown), such that a tension is applied to the intermediate transfer belt 20 that is provided around the support roller 24 and the drive roller 22. At the image holding side surface of the intermediate transfer belt 20, an intermediate transfer member cleaning device 30 is disposed to oppose the drive roller 22.

Developers of four colors of yellow, magenta, cyan and black, which are stored respectively in developer cartridges 8Y, 8M, 8C and 8K, are respectively supplied to developing devices (developing units) 4Y, 4M, 4C and 4K of units 10Y, 10M, 10C and 10K, respectively.

The first to fourth units 10Y, 10M, 10C and 10K each have a similar configuration, and, therefore, only the first unit 10Y, which forms a yellow image and is provided at an upstream side in the running direction of the intermediate transfer belt, will be described as a representative unit. The components in the second to fourth units 10M, 10C and 10K are respectively designated by the letter M for magenta, C for cyan and K for black, similarly to the manner in which the equivalent components in the first unit 10Y is indicated by Y for yellow, and description thereof is omitted.

The first unit 10Y includes a photoreceptor 1Y that functions as an electrostatic latent image holder. Around the photoreceptor 1Y, the following devices are provided in this order: a charge roller (charging unit) 2Y that charges a surface of the photoreceptor 1Y, an exposing device (electrostatic latent image forming unit) 3 that exposes the charged surface to a laser beam 3Y based on a color-separated image signal and forms an electrostatic latent image, a developing device (developing unit) 4Y that supplies charged toner to the electrostatic latent image and develops the electrostatic latent image, a primary transfer roller 5Y (primary transfer unit) that transfers the developed toner image to the intermediate transfer belt 20, and a photoreceptor cleaning device (cleaning unit) 6Y that removes residual toner from the surface of the photoreceptor 1Y after the primary transfer.

The primary transfer roller 5Y is provided at the inner side of the intermediate transfer belt 20, and is positioned at which the intermediate transfer belt 20 contacts the photoreceptor 1Y. Further, the primary transfer rollers 5Y, 5M, 5C and 5K are respectively connected to bias power sources (not shown) that apply primary transfer biases to the primary transfer rollers. Each bias power source is controlled by a control unit (not shown) such that the transfer bias applied to the corresponding primary transfer roller can be changed.

Next, an operation of forming a yellow image at the first unit 10Y will be explained. First, before the image-forming operation is performed, a surface of the photoreceptor 1Y is charged to an electric potential of approximately from −600 volts to −800 volts by the charge roller 2Y.

The photoreceptor 1Y is formed by providing a photosensitive layer on a conductive substrate (having a volume resistivity at 20° C. of $1\times10^{-6}$ Ωcm or less). The photosensitive layer normally has a high electric resistance (, which is comparable to the electric resistance of a usual resin), but possesses characteristics such that when the photosensitive layer is irradiated with the laser beam 3Y, the specific electric resistance of the portion irradiated with the laser beam changes. The laser beam 3Y is output from the exposing device 3 to the surface of the charged photoreceptor 1Y, according to image data for yellow sent from a control unit (not shown). The laser beam 3Y is irradiated to the photosensitive layer disposed at the surface of the photoreceptor 1Y, whereby an electrostatic latent image having a printing pattern for yellow is formed at the surface of the photoreceptor 1Y.

The developing device 4Y accommodates a developer containing a yellow toner (a developer according to the present exemplary embodiment). The yellow toner undergoes frictional charging by agitation in the interior of the developing device 4Y, and thus acquires a charge with the same polarity (negative polarity) as that of the charge on the photoreceptor 1Y, and the yellow toner is retained on a developer roll (developer holder). When the surface of the photoreceptor 1Y passes the developing device 4Y, the yellow toner is electrostatically attracted to diselectrified latent image portions of the surface of the photoreceptor 1Y, thereby developing the latent image with the yellow toner. The photoreceptor 1Y, on which a yellow toner image has been formed, is continued to be run, and the toner image developed on the photoreceptor 1Y is conveyed to a primary transfer position.

When the yellow toner image on the photoreceptor 1Y is conveyed to the primary transfer position, a primary transfer bias is applied to the primary transfer roller 5Y a static electricity force directed from the photoreceptor 1Y to the primary transfer roller 5Y acts upon the toner image, and the toner image on the photoreceptor 1Y is transferred to the intermediate transfer belt 20. The transfer bias applied at this time has a (positive) polarity opposite to the charge polarity (negative polarity) of the toner.

On the other hand, toner remaining on the photoreceptor 1Y is removed and recovered with the cleaning device 6Y. The cleaning device 6Y removes residual toner (including toner particles, fatty acid metal salt particles, other external additives and the like) and scattered carrier or the like, by contacting the cleaning blade with the photoreceptor 1Y Here, the toner according to the present exemplary embodiment is used as the yellow toner. Since uneven wear of the photoreceptor 1Y is suppressed thereby, an image in which image density unevenness is suppressed may be obtained.

Primary transfer biases respectively applied to the primary transfer roller 5M, 5C and 5K at the second units 10M, 10C, and 10K are controlled similarly to the primary transfer bias of the first unit.

In this manner, the intermediate transfer belt 20, to which a yellow toner image has been transferred from the first unit 10Y, is conveyed in sequence past the second to fourth units 10M, 10C and 10K, and toner images of the respective colors are superposed on one another during the transfer operations by the respective units.

The intermediate transfer belt 20, to which toner images of four colors have been respectively transferred by the first to fourth units, arrives at a secondary transfer portion formed by the intermediate transfer belt 20, the support roller 24 that contacts the inner surface of the intermediate transfer belt 20, and a secondary transfer roller (secondary transfer unit) 26 provided at an image holding surface side of the intermediate transfer belt 20. Meanwhile, recording paper (transfer receiving material) P is supplied, by a supply mechanism, to between the secondary transfer roller 26 and the intermediate transfer belt 20 that are in pressure contact with each other, and a secondary transfer bias is applied to the support roller 24. The transfer bias of the secondary transfer bias has a (negative) polarity that is the same as the charging polarity (negative polarity) of the toner, and a static electricity force directed from the intermediate transfer belt 20 towards the recording paper P acts upon the toner image, whereby the toner image on the intermediate transfer belt 20 is transferred to the recording paper P. The secondary transfer bias for the secondary transfer is determined according to the electric resistance detected by a resistance detecting unit (not shown) that detects the electric resistance of the secondary transfer portion, and the voltage of the secondary transfer bias is controlled accordingly.

Subsequently, the recording paper P is sent to a fixing device (fixing unit) 28, and the toner image is heated, whereby the toner image, formed by superposed color toner images, melts and is fixed on the recording paper P. The recording paper P after completion of the color image fixing is then sent to a discharge portion.

In the image forming device exemplified above, a toner image is transferred to the recording paper P via the intermediate transfer belt 20; however, the invention is not limited to this configuration, and may have a structure in which a toner image is transferred directly from a photoreceptor to recording paper.

EXAMPLES

In the following, the present invention is explained in detail by way of examples; however, the present invention is not limited to these examples. Further, unless specifically indicated otherwise, "parts" and "%" refer to "parts by weight" and "% by weight", respectively.

<Production of Toner Particle 1>

A pigment dispersion liquid is prepared by dissolving/dispersing 20 parts of C.I. Pigment Blue B15:3, 75 parts of ethyl acetate, 4 parts of solvent-removed DISPARLON DA-703-50 ((trade name) polyester acid amide amine salt, manufactured by Kusumoto Chemicals, Ltd.), and 1 part of SOLSPERSE 5000 ((trade name) (pigment derivative, manufactured by AstraZeneca PLC)), using a sand mill.

30 parts of paraffin wax (melting point: 89° C.) as a release agent and 270 parts of ethyl acetate are wet-milled by a DCP mill while cooled to 10° C., so that a wax dispersion liquid is prepared. 136 parts of polyester resin (having a Tg of 60° C. and a softening point of 115° C., and formed from bisphenol A propylene oxide adduct, bisphenol A ethylene oxide adduct, ethylene glycol, terephthalic acid, isophthalic acid, fumaric acid and adipic acid as monomer raw materials), 34 parts of the pigment dispersion liquid and 56 parts of ethyl acetate are agitated. Then, 75 parts of the wax dispersion liquid is added thereto, and the mixture is well agitated until the mixture becomes uniform. The obtained liquid is referred to as "liquid A".

124 parts of calcium carbonate dispersion liquid formed by mixing and dispersing calcium carbonate particles having an average particle diameter of 0.2 μm and water at a ratio of 45:55 (calcium carbonate:water), 99 parts of a 2% aqueous solution of CELLOGEN BS-H ((trade name) manufactured by Dai-Ichi Kogyo Seiyaku Co., Ltd.), and 157 parts of water are mixed and agitated for 5 minutes, using a homogenizer (ULTRA-TURRAX: manufactured by IKA), The obtained liquid is referred to as "liquid B".

250 parts of liquid A is added to 345 parts of liquid B while the liquid B is agitated at 10,000 rpm using the homogenizer (ULTRA-TURRAX: manufactured by IKA). The resultant mixture solution is agitated for 1 minute to form a suspension. Thereafter, the solvent is removed while the suspension is agitated by a propeller-agitator at room temperature and ordinary pressure. Next, calcium carbonate is removed by adding hydrochloric acid. Then, washing with water, each cycle of which includes addition into ion exchange water and separation by filtration, is repeated until the electroconductivity of filtrate becomes 2 μS/cm, and the filtration residue is dried using a vacuum dryer. The dried product is classified using an Elbow-jet classifier to remove fine powder and coarse powder, as a result of which toner particles 1 having an average particle diameter of 7.2 μm, which is a cyan toner, is obtained.

<Production of Carrier>

(Production of Carrier 1)

| | |
|---|---|
| Phenol | 40 parts |
| Formalin | 60 parts |
| Magnetite (spherical magnetite particulate powder having a volume average particle diameter of 0.10 μm; treated with 1 weight % by KBM 403 (manufactured by Toda Kogyo Corp,)) | 430 parts |
| Aqueous ammonia (30%) | 12 parts |
| Ion exchange water | 60 parts |

The temperature of a mixture of the above components is raised gradually to 85° C. while mixing and agitating, and the components are reacted for 5 hours to be cured. Then, the reaction product is cooled, filtered, washed and dried, whereby spherical carrier core particles 1 having a particle diameter of 37 μm are obtained.

| | |
|---|---|
| Carrier core particles 1 | 1,000 parts |
| Styrene (St)/methyl methacrylate (MMA) resin (copolymerization ratio 25:75) | 23 parts |
| Carbon black | 2 parts |
| Toluene | 400 parts |

The above components are placed in a depressurizing and heating kneader, mixed, and then dried under reduced pressure while being heated at 70° C. The obtained mixture is sieved with a sieve made by SUS (stainless steel) with a particle size mesh of 200 (TEST SIEVE ST 200ϕ×45H; 75 μm (having an opening of 75 μm; manufactured by Tokyo Glass Kikai Co., Ltd.)), and carrier 1 is obtained. The shape factor SF1 of carrier 1 is 122.

(Production of Carrier 2)

| | |
|---|---|
| Mn—Mg ferrite particles (volume average particle diameter = 38 μm; shape factor: 125) | 1,000 parts |
| Styrene (St)/methyl methacrylate (MMA) resin (copolymerization ratio 25:75) | 23 parts |
| Carbon black | 2 parts |
| Toluene | 400 parts |

The above components are placed in a depressurizing and heating kneader, mixed, and then dried under reduced pressure while being heated at 70° C. The obtained mixture is sieved with a sieve made by SUS (stainless steel) with a particle size mesh of 200 (TEST SIEVE ST 200ϕ×45H; 75 μm (opening of 75 μm; manufactured by Tokyo Glass Kikai Co., Ltd.) and carrier 2 is obtained. The shape factor SF1 of carrier 2 is 125.

(Production of Carrier 3)

Carrier 3 is obtained in the same manner as the production of carrier 2 except that Mn—Mg ferrite particles (volume average particle diameter=39 μm, shape factor: 128) are used in place of the Mn—Mg ferrite particles used in carrier 2. The shape factor SF1 of carrier 3 is 127.

(Production of Carrier 4)

Carrier 4 is obtained in the same manner as the production of carrier 2 except that Mn—Mg ferrite particles (volume average particle diameter=39 μm, shape factor: 130) are used in place of the Mn—Mg ferrite particles used in carrier 2. The shape factor SF1 of carrier 4 is 129.

(Production of Carrier 5)

Carrier 5 is obtained in the same manner as the production of carrier 2 except that Mn—Mg ferrite particles (volume average particle diameter=39 μm, shape factor: 133) are used in place of the Mn—Mg ferrite particles used in carrier 2. The shape factor SF1 of carrier 5 is 132.

<Production of Fatty Acid Metal Salt>

(Production of Zinc Stearate Particles 1)

1,422 parts of stearic acid is added to 10,000 parts of ethanol, and mixed together at 75° C. 507 parts of zinc hydroxide is gradually added to the mixture, and is mixed for one hour after completion of the addition. The resultant mixture is cooled to 20° C., and the reaction product is filtered to remove reaction residue and ethanol. The obtained reaction solid product is dried at 150° C. for 3 hours using a heating vacuum drier. The dried product is taken out from the drier, and is allowed to stand for cooling, as a result of which a solid product of zinc stearate is obtained. After the obtained solid product is milled using a jet mill, the milled product is classified using an ELBOW-JET CLASSIFIER (available from Matsubo Corporation), whereby powdery zinc stearate particles 1 having a volume average particle diameter of 9.6 μm are obtained. The classification cut points when the particles are classified using Elbow-jet classifier are shown in Table 1. The particle size distribution (the ratio of particles having a particle diameter of 25 μm or more, and the ratio of particles having a particle diameter of 40 μm or more) of the obtained zinc stearate particles 1 is shown in Table 1.

(Production of Zinc Stearate Particles 2 to 15)

Zinc stearate particle 1 are further classified using the Elbow-jet classifier, whereby zinc stearate particles 2 to 15 are prepared. The classification cut points when the particles are classified using the Elbow-jet classifier are shown in Table 1. Further, the particle size distributions of prepared zinc stearate particles 2 to 15 are shown in Table 1.

(Production of Zinc Laurate Particles 1)

1,001 parts of laulic acid is added to 10,000 parts of ethanol, and mixed together at 75° C. 507 parts of zinc hydroxide is gradually added to the mixture, and mixed for one hour after completion of the addition. The resultant mixture is cooled to 20° C., and the reaction product is filtered to remove reaction residue and ethanol. The obtained reaction solid product is dried at 150° C. for 3 hours using a heating vacuum drier. The product is taken out from the drier, and is allowed to stand for cooling, as a result of which a solid product of zinc laulate is obtained. The obtained solid product is milled and classified in a similar manner to the production of zinc stearate particles 1, and further classified in a similar manner to the production of zinc stearate particles 6, as a result of which zinc laulate particles 1 are obtained. The particle size distribution of the obtained zinc laurate particles 1 is shown in Table 1.

(Production of Magnesium Stearate Particles 1)

1,422 parts of stearic acid is added to 10,000 parts of ethanol, and mixed together at 75° C. 298 parts of magnesium hydroxide is gradually added to the mixture, and mixed for one hour after completion of the addition. The resultant mixture is cooled to 20° C., and the reaction product is filtered to remove ethanol and reaction residue. The obtained reaction solid product is dried at 150° C. for 3 hours using a heating vacuum drier. The product is taken out from the drier, and is allowed to stand for cooling, as a result of which a solid product of magnesium stearate is obtained. The obtained solid product is milled and classified in a similar manner to the production of zinc stearate particles 1, and further classified in a similar manner to the production of zinc stearate particles 6, as a result of which magnesium stearate particles 1 are obtained. The particle size distribution of the obtained magnesium stearate particles 1 is shown in Table 1.

TABLE 1

| | Classification cut point (μm) | Ratio (%) of particles having diameter of 25 μm or more | Ratio (%) of particles having diameter of 40 μm or more |
|---|---|---|---|
| Zinc stearate particles 1 | — | 49 | 6.1 |
| Zinc stearate particles 2 | 5 | 1 | 0.1 |
| Zinc stearate particles 3 | 6 | 2 | 0.3 |
| Zinc stearate particles 4 | 7 | 3 | 0.4 |
| Zinc stearate particles 5 | 9 | 5 | 0.6 |
| Zinc stearate particles 6 | 12 | 7 | 0.9 |
| Zinc stearate particles 7 | 14 | 9 | 1.1 |

TABLE 1-continued

| | Classification cut point (μm) | Ratio (%) of particles having diameter of 25 μm or more | Ratio (%) of particles having diameter of 40 μm or more |
|---|---|---|---|
| Zinc stearate particles 8 | 16 | 11 | 1.4 |
| Zinc stearate particles 9 | 19 | 13 | 1.6 |
| Zinc stearate particles 10 | 21 | 15 | 1.9 |
| Zinc stearate particles 11 | 28 | 22 | 2.8 |
| Zinc stearate particles 12 | 30 | 24 | 3 |
| Zinc stearate particles 13 | 33 | 28 | 3.5 |
| Zinc stearate particles 14 | 36 | 31 | 3.9 |
| Zinc stearate particles 15 | 44 | 41 | 5.1 |
| Zinc laurate particles 1 | 12 | 7 | 0.9 |
| Magnesium stearate particles 1 | 12 | 7 | 0.9 |

<Production of Toner 1 and Developer 1>

| | |
|---|---|
| Toner particles 1 | 99 parts |
| Silica particles ((R972(trade name) manufactured by Nippon Aerosil Co., Ltd.) | 1.0 part |
| Zinc stearate particles 11 | 0.22 parts |

The above components are mixed by a Henschel mixer for 5 minutes at 3,000 rpm, and toner 1 for use in Example 1 is obtained. Subsequently, toner 1 and carrier 1 are mixed at a ratio of 8 parts of toner 1 with respect to 100 parts of carrier 1 at 40 rpm by a type V blender at room temperature of 25° C. for 20 minutes. The mixture is sieved with a sieve with 150 mesh (having an opening of 0.106 mm) made by SUS (stainless steel), whereby developer 1 for use in Example 1 is obtained. The following ratios are measured, according to the method described above, with respect to toner 1: the ratio of the weight of the zinc stearate salt particles (fatty acid metal salt particles) to 100 parts by weight of the toner particles, the ratio of the weight of zinc stearate salt particles remaining on the sieve to the total weight of the toner when toner 1 is sieved with a sieve having an opening of 25 μm, and the ratio of the weight of zinc stearate salt particles remaining on the sieve to the total weight of the toner when toner 1 is sieved with a sieve having an opening of 45 μm. The results are shown in Table 2 (toners 2 to 23 are also measured similarly, and the results thereof are shown in Table 2).

<Production of Toner 2 and Developer 2>

Toner 2 and developer 2 are obtained in the same manner as the production of toner 1 and developer 1, except that 0.75 parts of zinc laurate particle 1 are used in place of the 0.22 parts of zinc stearate particle 11 used in the process of producing toner 1 and developer 1.

<Production of Toner 3 and Developer 3>

Toner 3 and developer 3 are obtained in the same manner as the production of toner 1 and developer 1, except that 0.75 parts of magnesium stearate particles 1 are used in place of the 0.22 parts of zinc stearate particles 11 used in the process of producing toner 1 and developer 1.

<Production of Toner 4 and Developer 4>

Toner 4 and developer 4 are obtained in the same manner as the production of toner 1 and developer 1, except that 0.45 parts of zinc stearate particles 8 are used in place of the 0.22 parts of zinc stearate particles 11 used in the process of producing toner 1 and developer 1.

<Production of Toner 5 and Developer 5>

Toner 5 and developer 5 are obtained in the same manner as the production of toner 1 and developer 1, except that 0.75 parts of zinc stearate particles 6 are used in place of the 0.22 parts of zinc stearate particles 11 used in the process of producing toner 1 and developer 1.

<Production of Toner 6 and Developer 6>

Toner 6 and developer 6 are obtained in the same manner as the production of toner 1 and developer 1, except that 0.95 parts of zinc stearate particles 5 are used in place of the 0.22 parts of zinc stearate particles 11 used in the process of producing toner 1 and developer 1.

<Production of Toner 7 and Developer 7>

Toner 7 and developer 7 are obtained in the same manner as the production of toner 1 and developer 1 except that 1.1 parts of zinc stearate particles 5 are used in place of the 0.22 parts of zinc stearate particles 11 used in the process of producing toner 1 and developer 1.

<Production of Toner 8 and Developer 8>

Toner 8 and developer 8 are obtained in the same manner as the production of toner 1 and developer 1, except that 2.8 parts of zinc stearate particles 3 are used in place of the 0.22 parts of zinc stearate particles 11 used in the process of producing toner 1 and developer 1.

<Production of Toner 9 and Developer 9>

Toner 9 and developer 9 are obtained in the same manner as the production of toner 1 and developer 1, except that 3.1 parts of zinc stearate particles 3 are used in place of the 0.22 parts of zinc stearate particles 11 used in the process of producing toner 1 and developer 1.

<Production of Toner 10 and Developer 10>

Toner 10 and developer 10 are obtained in the same manner as the production of toner 1 and developer 1, except that 4.8 parts of zinc stearate particles 2 are used in place of the 0.22 parts of zinc stearate particles 11 used in the process of producing toner 1 and developer 1.

<Production of Toner 11 and Developer 11>

Toner 11 and developer 11 are obtained in the same manner as the production of toner 1 and developer 1, except that 0.1 parts of zinc stearate particle 1 are used in place of 0.22 parts of zinc stearate particle 11 in the process of producing toner 1 and developer 1.

<Production of Toner 12 and Developer 12>

Toner 12 and developer 12 are obtained in the same manner as the production of toner 1 and developer 1, except that 5.3 parts of zinc stearate particles 2 are used in place of the 0.22 parts of zinc stearate particles 11 used in the process of producing toner 1 and developer 1.

<Production of Toner 13 and Developer 13>

Toner 13 and developer 13 are obtained in the same manner as the production of toner 1 and developer 1, except that 0.37 parts of zinc stearate particles 2 are used in place of the 0.22 parts of zinc stearate particles 11 used in the process of producing toner 1 and developer 1.

<Production of Toner 14 and Developer 14>

Toner 14 and developer 14 are obtained in the same manner as the production of toner 1 and developer 1, except that 0.75 parts of zinc stearate particles 3 are used in place of the 0.22 parts of zinc stearate particles 11 used in the process of producing toner 1 and developer 1.

<Production of Toner 15 and Developer 15>

Toner 15 and developer 15 are obtained in the same manner as the production of toner 1 and developer 1, except that 0.75 parts of zinc stearate particles 4 are used in place of the 0.22 parts of zinc stearate particles 11 used in the process of producing toner 1 and developer 1.

<Production of Toner 16 and Developer 16>

Toner 16 and developer 16 are obtained in the same manner as the production of toner 1 and developer 1, except that 0.75 parts of zinc stearate particles 5 are used in place of the 0.22 parts of zinc stearate particles 11 used in the process of producing toner 1 and developer 1.

<Production of Toner 17 and Developer 17>

Toner 17 and developer 17 are obtained in the same manner as the production of toner 1 and developer 1, except that 0.75 parts of zinc stearate particles 7 are used in place of the 0.22 parts of zinc stearate particles 11 used in the process of producing toner 1 and developer 1.

<Production of Toner 18 and Developer 18>

Toner 18 and developer 18 are obtained in the same manner as the production of toner 1 and developer 1, except that 0.75 parts of zinc stearate particles 9 are used in place of the 0.22 parts of zinc stearate particles 11 used in the process of producing toner 1 and developer 1.

<Production of Toner 19 and Developer 19>

Toner 19 and developer 19 are obtained in the same manner as the production of toner 1 and developer 1, except that 0.75 parts of zinc stearate particles 10 are used in place of the 0.22 parts of zinc stearate particles 11 used in the process of producing toner 1 and developer 1.

<Production of Toner 20 and Developer 20>

Toner 20 and developer 20 are obtained in the same manner as the production of toner 1 and developer 1, except that 0.75 parts of zinc stearate particles 12 are used in place of the 0.22 parts of zinc stearate particles 11 used in the process of producing toner 1 and developer 1.

<Production of Toner 21 and Developer 21>

Toner 21 and developer 21 are obtained in the same manner as the production of toner 1 and developer 1, except that 0.75 parts of zinc stearate particles 13 are used in place of the 0.22 parts of zinc stearate particles 11 used in the process of producing toner 1 and developer 1.

<Production of Toner 22 and Developer 22>

Toner 22 and developer 22 are obtained in the same manner as the production of toner 1 and developer 1, except that 0.75 parts of zinc stearate particles 14 are used in place of the 0.22 parts of zinc stearate particles 11 used in the process of producing toner 1 and developer 1.

<Production of Toner 23 and Developer 23>

Toner 23 and developer 23 are obtained in the same manner as the production of toner 1 and developer 1, except that 0.75 parts of zinc stearate particles 15 are used in place of the 0.22 parts of zinc stearate particles 11 used in the process of producing toner 1 and developer 1.

<Production of Developer 24>

Developer 24 is obtained in the same manner as developer 5, except that carrier 2 is used in place of carrier 1 used in the process of producing developer 5.

<Production of Developer 25>

Developer 25 is obtained in the same manner as developer 5, except that carrier 3 is used in place of carrier 1 used in the process of producing developer 5.

<Production of Developer 26>

Developer 26 is obtained in the same manner as developer 5, except that carrier 4 is used in place of carrier 1 used in the process of producing developer 5.

<Production of Developer 27>

Developer 27 is obtained in the same manner as developer 5, except that carrier 5 is used in place of carrier 1 used in the process of producing developer 5.

The following ratios are measured, according to the method described above, with respect to toners 1 to 23: the content of the fatty acid metal salt particles relative to 100 parts by weight of the toner particles, the ratio (%) of the weight of fatty acid metal salt particles remaining on the sieve relative to the total weight of the toner when the toner is sieved with a sieve having an opening of 25 μm, and the ratio (%) of the weight of fatty acid metal salt particles remaining on the sieve relative to the total weight of the toner when the toner is sieved with a sieve having an opening of 45 μm. The results are shown in Table 2.

Examples 1 to 23 and Comparative Examples 1 to 4

Evaluation

—Image Forming Conditions—

For outputting images, a DOCUCENTRECOLOR F450 ((trade name) manufactured by Fuji Xerox Co., Ltd.) is modified. Specifically, all developers are removed from the DOCUCENTRECOLOR F450, and, instead, toners 1 to 23 and developers 1 to 27 shown in Table 2 are respectively filled into a cyan toner cartridge and a developer unit, to from a evaluation test device. Regarding developers 24 to 27, toner 5 is used as the toner. The paper used is A4 size paper (C2 paper manufactured by Fuji Xerox Co., Ltd.), and A4 size sheets of the paper are fed in the paper transverse direction, and print tests are carried out. Regarding the images to be printed for evaluation, solid images of 1.2 cm×17.0 cm (the long sides of the solid images are parallel to the output direction) are outputted at positions of 4 cm, 14 cm and 23 cm, respectively, from the upper edge of the A4 size paper in the longitudinal direction, and used as a test chart. Further, the image density is measured using an X-RITE 938 (manufactured by X-Rite Inc.). The average value of values of five measurements in the area to be measured is taken as the image density. The image density is adjusted each time printing is performed on 1,000 sheets, on the basis of the density measurement results of printed images, such that the image density ID is in the range of from 1.25 to 1.55. The cycle of evaluation is started in conditions of a temperature of 22° C. and a humidity of 55% RH environments in a conditioned room. The evaluation environment is changed every 20,000 prints, such that the environment is changed from the above initial environment to an environment of a temperature of 28° C. and a humidity of 80% RH, and then to an environment of a temperature of 10° C. and a humidity of 20% RH, and then returns to the initial environment of a temperature of 22° C. and a humidity of 55% RH.

(Evaluation of Image Density Unevenness)

After image formation is performed on 120,000 sheets, a halftone image having an image density ID in the range of from 0.6 to 0.8 is printed on an entire one surface of a sheet of the A4 paper, and the absolute values of image density difference A between the image density of the halftone image in an area corresponding to an image area of the test chart and the density of the halftone image in an area corresponding to a non-image area of the test chart is determined, and evaluated in accordance with the following evaluation criteria. The evaluation results are shown in Table 2.

A: less than 0.03:

B: from 0.03 to less than 0.07;

C: from 0.07 to less than 0.1; and

D: 0.1 or more.

(Evaluation of Color Streak)

The entire-surface halftone image is printed on two sheets of the A4-sized paper, and the total number of visually distinguishable color streaks and color dots in the images on the two sheets are counted. The number is shown in Table 2. Here, acceptable ranges of the total number of color streaks and color dots are 5 or less.

TABLE 2

| | | | Fatty acid metal salt particles | | | Evaluation | |
|---|---|---|---|---|---|---|---|
| | Toner number | Developer number | Content (parts) of fatty acid metal salt particles relative to 100 parts of toner particles | Ratio (%) of fatty acid metal salt particles remaining on 25 μm-sieve relative to toner | Ratio (%) of fatty acid metal salt particles remaining on 45 μm-sieve relative to toner | Image density unevenness | Number of color streaks |
| Example 1 | 1 | 1 | 0.22 | 0.048 | 0.006 | C | 0 |
| Example 2 | 2 | 2 | 0.74 | 0.053 | 0.007 | B | 0 |
| Example 3 | 3 | 3 | 0.74 | 0.052 | 0.007 | B | 0 |
| Example 4 | 4 | 4 | 0.45 | 0.050 | 0.006 | C | 0 |
| Example 5 | 5 | 5 | 0.74 | 0.053 | 0.007 | A | 0 |
| Example 6 | 6 | 6 | 0.94 | 0.048 | 0.006 | A | 0 |
| Example 7 | 7 | 7 | 1.09 | 0.055 | 0.007 | B | 0 |
| Example 8 | 8 | 8 | 2.72 | 0.056 | 0.007 | B | 0 |
| Example 9 | 9 | 9 | 3.01 | 0.062 | 0.008 | C | 0 |
| Example 10 | 10 | 10 | 4.58 | 0.048 | 0.006 | C | 0 |
| Example 11 | 14 | 14 | 0.74 | 0.015 | 0.002 | A | 0 |
| Example 12 | 15 | 15 | 0.74 | 0.023 | 0.003 | A | 0 |
| Example 13 | 16 | 16 | 0.74 | 0.038 | 0.003 | A | 0 |
| Example 14 | 17 | 17 | 0.74 | 0.068 | 0.008 | A | 0 |
| Example 15 | 18 | 18 | 0.74 | 0.098 | 0.012 | A | 0 |
| Example 16 | 19 | 19 | 0.74 | 0.113 | 0.014 | B | 0 |
| Example 17 | 20 | 20 | 0.74 | 0.180 | 0.023 | B | 0 |
| Example 18 | 21 | 21 | 0.74 | 0.210 | 0.026 | C | 0 |
| Example 19 | 22 | 22 | 0.74 | 0.233 | 0.029 | C | 0 |
| Example 20 | 5 | 24 | 0.74 | 0.053 | 0.007 | A | 1 |
| Example 21 | 5 | 25 | 0.74 | 0.053 | 0.007 | A | 2 |
| Example 22 | 5 | 26 | 0.74 | 0.053 | 0.007 | A | 3 |
| Example 23 | 5 | 27 | 0.74 | 0.053 | 0.007 | A | 5 |
| Comparative Example 1 | 11 | 11 | 0.10 | 0.049 | 0.006 | D | 0 |
| Comparative Example 2 | 12 | 12 | 5.30 | 0.051 | 0.006 | D | 0 |
| Comparative Example 3 | 13 | 13 | 0.74 | 0.014 | 0.002 | D | 0 |
| Comparative Example 4 | 23 | 23 | 0.74 | 0.308 | 0.038 | D | 0 |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner for electrostatic charge image development comprising:

toner particles; and fatty acid metal salt particles, a content of the fatty acid metal salt particles being from about 0.2 parts by weight to about 5 parts by weight with respect to 100 parts by weight of the toner particles, and, in a particle size distribution of the fatty acid metal salt particles, a proportion of the fatty acid metal salt particles having a particle diameter of 25 μm or more is from about 4.0% by weight to about 30.0% by weight with respect to a total weight of the fatty acid metal salt particles, and a proportion of the fatty acid metal salt particles having a particle diameter of 40 μm or more is about 2.0% by weight or less with respect to the total weight of the fatty acid metal salt particles, and the toner satisfies the following formulas $$0.015\% \leq A \leq 0.300\%$$

$$B \leq 0.03\%$$

where:

A represents a weight of the fatty acid metal salt particles remaining on a sieve having an opening of 25 μm when the toner is sieved with the sieve having an opening of 25 μm with respect to a total weight of the toner under the following conditions:

an elemental analysis of a surface of the toner particles is performed by X-ray fluorescence spectroscopy to determine a weight, if any, of particles other than the fatty acid metal salt particles in the toner, 30.0 g of toner is added into a beaker containing 500 g of a 3.0% by weight aqueous sodium dodecylbenzene sulfonate solution while stirring, and a toner dispersion liquid is prepared using an ultrasonic cleaner, a Buchner funnel for ϕ70 mm filter paper is attached to a suction bottle, and a stainless-steel sieve having an opening of 25 μm, ϕ75 mm, and a height of 20 mm for a test with a tare weighted is set onto the Buchner funnel, a gap between the sieve and a side surface of the Buchner funnel is sealed, and the toner dispersion liquid is poured into the sieve from above while air is suctioned from the suction bottle, subsequently, 500 g of a 1.0% by weight aqueous sodium dodecylbenzene sulfonate solution is used for rinsing an inner surface of the Buchner funnel and a mesh portion of the sieve to remove the toner adhered to the mesh portion of the sieve, the mesh portion of the sieve is further rinsed with a mixed solution of ion exchange water and ethanol at a weight ratio of 80:20, the sieve is detached from the Buchner funnel and is air-dried, a weight of the sieve after being dried is weighed, and a difference in the sieve weight between before and after sieving is the amount of residue on the sieve per 30 g of the toner, a ratio of residue being thus obtained, as the ratio of the residue on the 25 μm opening sieve, an average of the measurement values is obtained by performing the above operations three times, and performing another elemental analysis to obtain a weight of particles other than the fatty acid metal salt particles in the residue, whereby the weight of only the fatty acid metal salt particles remaining on the sieve having an opening of 25 μm is obtained by subtracting the weight of particles other than the fatty acid metal salt particles in the residue from the weight of the residue; and B represents a weight of fatty acid metal salt particles remaining on a sieve having an opening of 45 μm when the toner is sieved with a sieve having an opening of 45 μm with respect to the total weight of the toner under the following conditions:

an elemental analysis of a surface of the toner particles is performed by X-ray fluorescence spectroscopy to determine a weight, if any, of particles other than the fatty acid metal salt particles in the toner, 30.0 g of toner is added into a beaker containing 500 g of a 3.0% by weight aqueous sodium dodecylbenzene sulfonate solution while stirring, and a toner dispersion liquid is prepared using an ultrasonic cleaner, a Buchner funnel for ϕ70 mm filter paper is attached to a suction bottle, and a stainless-steel sieve having an opening of 45 μm, ϕ75 mm, and a height of 20 mm for a test with a tare weighted is set onto the Buchner funnel, a gap between the sieve and a side surface of the Buchner funnel is sealed, and the toner dispersion liquid is poured onto the sieve from above while air is suctioned from the suction bottle, subsequently, 500 g of a 1.0% by weight aqueous sodium dodecylbenzene sulfonate solution is used for rinsing an inner surface of the Buchner funnel and a mesh portion of the sieve to remove the toner adhered to the mesh portion of the sieve, the mesh portion of the sieve is further rinsed with a mixed solution of ion exchange water and ethanol at a weight ratio of 80:20, the sieve is detached from the Buchner funnel and is air-dried, a weight of the sieve after being dried is weighed, and a difference in the sieve weight between before and after sieving is the amount of the residue on the sieve per 30 g of the toner, a ratio of residue being thus obtained, as the ratio of the residue on the 45 μm opening sieve, an average of the measurement values is obtained by performing the above operations three times, and performing another elemental analysis to obtain a weight of particles other than the fatty acid metal salt particles in the residue, whereby the weight of only the fatty acid metal salt particles remaining on the sieve having an opening of 45 μm is obtained by subtracting the weight of particles other than the fatty acid metal salt particles in the residue from the weight of the residue.

2. The toner for electrostatic charge image development according to claim 1, wherein the fatty acid metal salt particles are zinc stearate particles.

3. The toner for electrostatic charge image development according to claim 1, further comprising a release agent.

4. The toner for electrostatic charge image development according to claim 3, wherein the release agent is paraffin wax.

5. The toner for electrostatic charge image development according to claim 1, further comprising silica as an external additive.

6. The toner for electrostatic charge image development according to claim 1, wherein the volume average particle diameter of the toner particles is from about 4 μm to about 10 μm.

7. An electrostatic charge image developer comprising the toner for electrostatic charge image development according to claim 1 and a carrier.

8. The electrostatic charge image developer according to claim 7, wherein the carrier comprises carrier particles having a shape factor SF1 of about 127 or less.

9. The electrostatic charge image developer according to claim 7, wherein the carrier comprises carrier particles coated with a coating resin and the coating resin is a styrene-acrylic resin.

10. The electrostatic charge image developer according to claim 7, wherein the carrier comprises carrier particles having a volume average particle diameter of from about 20 μm to about 70 μm.

11. The electrostatic charge image developer according to claim 7, wherein the carrier comprises carrier particles, and a weight ratio of the toner particles to the carrier particles in the developer is from 1:100 to 30:100.

12. The toner for electrostatic charge image development according to claim 1, wherein the fatty acid metal salt particles comprise a fatty acid metal salt selected from the group consisting of aluminum stearate, calcium stearate, potassium stearate, magnesium stearate, barium stearate, lithium stearate, zinc stearate, copper stearate, lead stearate, nickel stearate, cobalt stearate, sodium stearate, zinc oleate, manganese oleate, iron oleate, aluminum oleate, copper oleate, magnesium oleate, calcium oleate, zinc palmitate, cobalt palmitate, copper palmitate, magnesium palmitate, aluminum palmitate, calcium palmitate, zinc laurate, manganese laurate, calcium laurate, iron laurate, magnesium laurate, aluminum laurate, zinc linolate, cobalt linolate, calcium linolate, zinc ricinoleate, and aluminum ricinoleate.

* * * * *